US012270195B2

(12) United States Patent
Djukic-Schröder et al.

(10) Patent No.: US 12,270,195 B2
(45) Date of Patent: Apr. 8, 2025

(54) ENERGY ROOM AS AN ENERGY CENTER

(71) Applicants: Daliborka Djukic-Schröder, Bielefeld (DE); Ralf Steppeler, Herzebrock-Clarholz (DE)

(72) Inventors: Daliborka Djukic-Schröder, Bielefeld (DE); Ralf Steppeler, Herzebrock-Clarholz (DE)

( * ) Notice: Subject to any disclaimer, the term of this patent is extended or adjusted under 35 U.S.C. 154(b) by 316 days.

(21) Appl. No.: 17/964,352

(22) Filed: Oct. 12, 2022

(65) Prior Publication Data

US 2024/0068225 A1 Feb. 29, 2024

(30) Foreign Application Priority Data

Aug. 23, 2022 (DE) ..... 10 2022 121 338.2
Sep. 1, 2022 (DE) ..... 10 2022 122 131.8

(51) Int. Cl.
*E04B 1/348* (2006.01)
*E04H 1/12* (2006.01)
*E04H 5/04* (2006.01)

(52) U.S. Cl.
CPC ..... *E04B 1/34869* (2013.01); *E04B 1/34823* (2013.01); *E04H 1/1238* (2013.01); *E04H 5/04* (2013.01); *E04B 2001/34892* (2013.01); *E04B 2103/02* (2013.01)

(58) Field of Classification Search
CPC ..... E04B 1/34869; E04B 1/34823; E04B 2001/34892; E04B 2103/02; E04H 1/1238; E04H 5/04
See application file for complete search history.

(56) References Cited

U.S. PATENT DOCUMENTS 3,727,753 A * 4/1973 Starr ..... E04B 1/34869 52/79.5
3,742,660 A 7/1973 Bierweiler
3,830,025 A * 8/1974 Wainshal ..... E04B 1/34823 52/79.14
5,285,914 A 2/1994 Del Zotto
5,299,709 A 4/1994 Beerbower
5,315,794 A * 5/1994 Pearson ..... E04H 5/04 52/169.6
5,778,608 A 7/1998 Elliott, Jr.
5,865,346 A 2/1999 Del Zotto
5,881,760 A 3/1999 Del Zotto
(Continued)

FOREIGN PATENT DOCUMENTS

CN 111305602 A * 6/2020
DE 69107339 T2 2/1995
(Continued)

*Primary Examiner* — Jessie T Fonseca

(57) ABSTRACT

An energy room for providing energy to a building that is physically separate from the energy room. The energy room contains on the one side service connections from public utilities and services and on the other side service connections to service lines that run to the building. The energy room becomes an energy center for the building by housing energy generation equipment and energy storage devices. The energy center generates energy that is supplied to the building, but also receives energy that is generated at the building and uses that energy to generate another form of energy and/or stores that energy to be delivered at a later time to the building.

12 Claims, 3 Drawing Sheets

(56) References Cited

U.S. PATENT DOCUMENTS

| | | | | |
|---|---|---|---|---|
| 6,349,510 | B1 * | 2/2002 | Haas | E04H 5/02 52/79.5 |
| 2011/0094166 | A1 | 4/2011 | Lavi | |
| 2017/0101782 | A1 * | 4/2017 | Becirovic | E04B 5/48 |

FOREIGN PATENT DOCUMENTS

| | | | | |
|---|---|---|---|---|
| DE | 10255335 | A1 | 6/2004 | |
| DE | 202006007580 | U1 | 8/2006 | |
| DE | 102014007672 | B4 | 10/2017 | |
| EP | 3363967 | A1 * | 8/2018 | E04H 5/04 |
| KR | 102176296 | B1 | 11/2020 | |
| WO | WO-2020237285 | A1 * | 12/2020 | E04B 1/16 |
| WO | WO-2021078973 | A1 * | 4/2021 | |

* cited by examiner

ENERGY ROOM AS AN ENERGY CENTER

BACKGROUND INFORMATION

Field of the Invention

The invention relates to the field of external service rooms that provide public utilities and services to a building. More particularly, the invention relates to an energy center that also stores energy that is supplied at a later time to the building.

Discussion of the Prior Art

Buildings, whether commercial buildings or residential houses, require a number of services to function properly. These services include public utilities, such as electricity, water, waste water sewage, etc., and other services that are not necessarily public utilities, such as telecommunications, but shall be included in the term 'public utilities and services.' The lines for the public utilities are typically buried beneath roadways, with an underground service channel extending from the roadway to the entry point on the building.

When a new building is under construction, the various utility companies come at different times to hook up the respective service line to a service connection that is located in the building below grade, which means that ground above the location of the service entry to the building is repeatedly dug up to gain access to the respective service connection. This is time-consuming and costly.

DE 10 2014 007 672 B4 discloses a prefabricated structure that provides service connection room to house service connections that lead to and from a building that uses the services. The service connection room has a body that includes a floor and walls, and a cover that rests on the upper faces of the walls, held in place by its own weight. This service connection room is installed underground, physically separate from the building, and contains the service connectors for public utilities and services coming in from outside the property and also service connectors to external disposal line or lines, for example, connections to a waste water system that is used to drain waste water and/or rainwater from the structure. In addition to the service connections, the service connection room also houses related systems and devices, such as shut-off devices, control and metering devices, conduits, pipes, and electrical lines, and is dimensioned to also provide the space required to inspect and maintain these devices.

Typically, the service lines leading into the service connection room are then routed into the building and the disposal lines leading into the service connection room from the building and are routed out to external lines. The lines may run between the service connection room and the building as individual supply and disposal lines, but alternatively a single multi-branch connector line may be provided, so that only a single break-through into and then out of the service connection room is needed, instead of multiple break-throughs to accommodate the various service lines. It is also conceivable that equipment for generating electricity may be installed in the service connection room, for example, a block-type thermal power station (BTTP), a combined heat and power unit (CHIP unit), a heat pump, etc., so that the prefabricated component that is referred to as the service connection room may also be called an energy room, namely, a room that supplies energy that is then consumed by the building connected to the energy room.

The service connection room described above offers many advantages over providing the service connections and the various conduits and related devices in the basement of the building. A service connection room that is separate from the building simplifies the process of connecting the various service lines, because hooking up the service connections to the external public utilities and services is decoupled from the construction of the building. The hook-ups can be made in the service connection room at any time, independently of the stage of construction of the building, and then, when the building is ready to begin operation, the various lines or the multi-branch services line can be hooked up to the building.

Locating the service connection room external to the building it serves also has the advantage that the space in the building that is typically taken up with equipment related to utilities and services is available for use as living or working space.

Another advantage is that the service connection room may be placed at the edge of the property, so it is as close as possible to where the underground lines of the public utilities and services are located. This reduces the costs for laying the individual supply and disposal lines from the road to the service connection room, particularly if laying those lines would otherwise require multiple excavations, which is what typically happens when a new building is connected to utility services.

Access to the interior of the service connection room is via an access opening directly on the service room. This considerably simplifies maintenance and repair work, inspections and meter readings, because it is not necessary for people to be in the building in order to let technicians in. Rather, it is sufficient to send an access code, a key, or the like to the technicians, which allows them to enter the service connection room, even when the building itself remains securely locked.

The service connection room described above is a prefabricated structure, which means that, depending on the needs of the specific building, service connection rooms of different sizes may be needed. Also, concerns about climate change mean that carbon-neutral energy-generating systems are increasingly being installed in buildings, residential and commercial, and those systems often require bulky storage tanks.

What is needed, therefore, is an energy room that is easily scalable to sizes that accommodate the very different needs that buildings may have. What is further needed is an energy center that promotes energy self-sufficient operation of a building. And what is yet further needed is such an energy center that offers the greatest possible security for a building.

BRIEF SUMMARY OF THE INVENTION

The object of the invention is to provide a structure, an 'energy room' that serves as an energy center for a building. The term 'energy center' as used hereinafter refers to an energy room according to the invention that is set up underground, physically separate from the one or more buildings that are connected to the energy room, and contains service connections for the utilities and services that are then delivered to the building. The energy center may also contain devices and equipment for generating and/or storing energy that is supplied to the building upon demand and may contain storage devices for storing energy that is generated at the building, stored in the energy center, and then delivered to the building upon demand. When referring hereinafter to the structure itself, the term 'energy room' will be used, the term 'energy center' shall refer to the energy room in which various kinds of energy generation and storage devices are installed, and the one or more buildings that the energy center serves, whether residential or commercial buildings, shall be referred to simply as the building.

In the conventional service connection room, the flow of energy is in one direction, i.e., from the service connection room to the building. The flow of energy is from the service connection room to the building and the only flow of material from the building to the service connection room is in the form of a waste water line. In the energy center according to the invention, energy may flow in both directions between the energy center and the building. For example, electrical energy or gas may be generated or water heated photovoltaically at the building. This energy is then fed to storage tanks in the energy center and then released back to the building upon demand.

Given the efforts in these times to reduce carbon emissions, a much greater variety of energy systems are now being installed in buildings than were traditionally used to provide electricity, heat, and cooking fuel. Many buildings are now equipped with photovoltaic systems for generating electricity and heating water, systems for generating hydrogen gas, etc. It is a goal of the present invention to provide an energy room to serve as an energy center for a building, an energy room that is readily adaptable to the needs of specific installations and is cost-effective in its manufacture, transportation, and installation.

The energy room according to the invention is essentially a prefabricated structure having a body and a cover. The body is a concrete structure with vertical walls and a floor. The cover is a concrete slab that is placed across the top of the walls to provide an enclosed space. An access opening is provided in the cover, which provides access to the interior of the energy room without having to remove the cover. The access opening is fitted with a lockable access door.

A stairway extends from the access opening down to the floor. It is, of course, possible to install a ladder instead of a stairway, but it is much easier to carry equipment down a stairway then it is a ladder. Also, using a ladder frequently requires that a second person be present, for safety reasons. Using a stairway means that a single person can do inspection and maintenance work, thereby making maintenance of the energy center more cost-effective. A first pass-through, referred to hereinafter as the 'public utilities pass-through' is provided in the body for service lines coming into and going out to public utilities and services, such as drinking water, gas, telecommunications, waste water disposal, rainwater disposal, etc. A second pass-through, referred to hereinafter as the 'building services pass-through' is provided for service lines going out to and coming in from the building.

The body of the energy room may be constructed as a single, complete structure, i.e., a poured-concrete structure that has four walls and a floor. But it may also be assembled from segments, which allow the size of the body to be sized to accommodate the planned technical and functional installations for a specific building simply by assembling the necessary number of segments. Two types of segments provide this flexibility: an end segment that has three walls and a floor, and an extension segment that has two opposing walls and a floor. Thus, the body of the energy room may be assembled from two end segments that are fastened together, or may be assembled from two end segments and one or more extension segments placed between the end segments to achieve the desired size. In this way, the dimensions of the energy room are easily and inexpensively scalable to the desired size of the energy center. Providing the body and the cover in segments also has advantages in that it allows the technical devices and equipment that will later be needed in the energy center to be pre-assembled on the individual segments, as will be discussed below.

For purposes of streamlining the production, the end segments and the extension segments may have the same footprint, i.e., the same width and length. In this case, the cover is made to fit that footprint, and thus, only one size cover is required to fit on an end segment or on an extension segment.

There are always safety considerations when technical equipment of the type needed to supply or store energy and to remove waste water is used. Although the risks are small, there is always a chance that a gas line or a waste-water disposal line might spring a leak, or that an electrical storage device might present a fire hazard. For this reason, the body and cover of the energy room according to the invention are constructed as fireproof and explosion-proof components and the cover is securely attached to the body. Fireproof means that the energy room can withstand heat and pressure loads from a fire for a certain period of time without collapsing. Explosion-proof means that, in the event of an explosion in the interior of the energy room, parts of the body itself or the equipment installed within the room will not be blown about in an uncontrolled manner. Should the energy room be damaged in the event of a fire or explosion, the fact that it is located underground at a distance from the building has the benefit that replacement or repair to the room and/or equipment is considerably less costly than would otherwise be associated with repairing the building.

An overpressure relief valve is provided in the cover that opens automatically when the pressure within the energy room exceeds a specified peak pressure value, such as occurs in the event of a fire or explosion. This relief valve reduces the pressure, thereby keeping damage in the energy room to a minimum. The access door serves as a suitable type of relief valve. The access door is a hinged flap or hatch door, with a lock, in order to prevent unauthorized persons from entering the energy room. The strength properties of the lock are designed such, that the lock releases and the access door springs open if the specified pressure limit within the energy body is exceeded. The hinged construction of the access door ensures that the door does not fly off uncontrollably. Alternatively, the pressure relief valve may by provided as a movable valve body that is normally urged against a valve seat by a spring. Should excessive pressure build up, the movable valve body is moved away from the valve seat against the spring action, opening up a flow path that allows the excessive pressure to be released to the outdoors.

Reinforced concrete is a very suitable material to achieve the desired fireproof and explosion-proof structural properties of the energy room. The body and cover are constructed of a suitably thick concrete that includes a suitably high proportion of reinforcing material, for example, rebar, to ensure that it is fireproof and explosion-proof. The thickness of the concrete and the relatively high proportion of reinforcement material increase the weight and, with regard to the cover, this increased weight also helps prevent the cover from being blown off the body in the event of an explosion.

The aggregate used to make the concrete may include plant fibers, e.g. wood fibers, as a replacement for at least part of the mineral aggregate. This results in a lower density of the concrete, which lowers the weight. Thus, the weight of the relatively large-volume component of the body may be considerably lower than the weight of the same component made with concrete material containing only mineral aggregate. This lower weight is a significant advantage when transporting the components, because they may be transported on public roadways without requiring the special permit that is typically required for transporting very heavy loads. As for the cover, it is a component that is spatially much smaller than the structural components of the body and the heavier weight from the use of mineral aggregate instead of plant fiber may be desirable.

The use of and the ratio of plant fiber to mineral aggregate is best determined when the specific conditions of the installation site are known, so that the considerations regarding a low-weight advantage for transport vs. high-weight advantage for safety reasons are adapted to the specific conditions. Depending on the type of soil where the energy center is being installed, it may be desirable that the body have a high weight, to counteract buoyancy. On the other hand, ecological considerations would recommend the use of plant fiber over the use of mineral aggregate, and this can be taken into account when determining what ratio of plant to mineral additives is most suitable.

The body may be made from self-compacting or self-consolidating concrete (SCC). SCC contains an additive that results in a very fluid mix with high passing ability, which improves the ability of the concrete mixture to flow into and fill out the formwork and eliminates the need for compaction. The low viscosity of the SCC allows the poured mixture to fill the framework completely, leaving virtually no cavities, even without the use of the compaction that is typically used to compact poured concrete. The low viscosity also means that the concrete mixture readily flows around reinforcing material, for example, a cage made of reinforcing steel that is incorporated into the concrete, thereby preventing the formation of cavities at the interface between the concrete and the reinforcing material. This improves the transmission of forces from the concrete to the reinforcement. The result is that a component made with SCC is able to withstand higher forces than a concrete component of the same dimensions made of conventional concrete. In other words, if a certain load capacity is specified, a component made with SCC may have a smaller wall thickness than a component made with conventional concrete.

Weight reduction for the cover is not so important, because it is desirable that the cover be heavy for the safety reasons discussed above. Weight considerations are often less critical with regard to transporting the cover, because it is essentially a flat component and also much smaller than the body or body segments. Weight considerations are more important with regard to the body, whether it be a monolithic body or be assembled from end segments and/or one or more extension segments. A large structure having a floor and four walls or a trough-like segment having floor and wall portions is more problematic in terms of maintaining a desired maximum weight because of multiple surfaces that extend on different planes. Nevertheless, there are advantages to using SCC to make the cover. SCC results in a more homogenous concrete, due to the lack of cavities, and that increases the mechanical loading that the concrete is able withstand. Cavities present weak points in the concrete and avoiding or eliminating them helps prevent the cover from breaking apart into shards and this is a particular advantage for the cover, because, unlike the walls and floor of the energy room, it is not buried underground.

The cover of the energy room according to the invention is also securely attached to the body, rather than simply placed on the body as with the conventional service connection room. Adhesive means are available that provide a strong bond and that are suitable for attaching the cover to the body. Should an explosion take place inside the body, the adhesive seam itself would likely withstand the stresses from the explosion, with the result that the portions of the walls and cover that are next to adhesive seam would be damaged.

A releasable means of attaching the cover to the body is, however, more desirable than an adhesive bond. Threaded fasteners, such as screws, bolts, turnbuckles, etc. provide a secure, yet releasable attachment that allows the cover to be removed when large-area access to the energy center is needed, for example, for bringing large-volume equipment, storage tanks, or the like into or out of the center. Threaded fasteners are particularly suitable for fastening components in the vertical direction, e.g. for affixing the cover to the walls of the body. Such fasteners are capable of withstanding high retaining forces, even with a relatively small cross-sectional dimension, and it is not a problem to provide the sufficient number of fasteners to hold the cover securely against the walls. The fasteners that attach the cover to the body are preferably accessible from the inside of the body, so that the cover may be released from the body and then later re-connected with as little effort as possible and without having to do ground work.

The access opening in the cover may also be provided with seals to create a flood-proof closure. This is achievable, for example, by means of double seals, in particular in conjunction with a tensioning device, which presses the closure, i.e., a hinged hatch or trapdoor, against a single or double seal. The tensioning device may be a screw or an eccentric lever that can be actuated without the use of a tool. In particular, the tensioning device may be constructed such, that it reliably presses the closure tightly against the seal of the access opening, yet allows the closure to open in the event of an explosion occurring inside the energy center, so that the access opening and its closure serve as a pressure relief valve.

Vents for air are provided in the energy room, to prevent the build-up of harmful gases inside the power station, which would present a risk of fire or an explosion, and would also be a health hazard to a person inspecting or working within the energy center. The intake and exhaust vents are placed in locations that will ensure cross-ventilation within the energy center. A suitable location for the vents is in the cover, which is not underground, because this eliminates the need to run ventilation pipes or the like externally along the sides of the energy room. If a BTTP unit is installed in the energy room, then the vent for air intake is located away from the chimney of the BTTP unit.

Air intake and exhaust vents may be adhesively affixed onto the cover and extend sufficiently high above the surface of the cover to avoid the ingress of water in the event of heavy rainfall. The height of the air vents is best based on the requirements of flood protection in the area where the energy room is to be installed. A semi-round covering or plate may be used to cover the intake and exhaust openings, the covering having a diameter greater than that of the pipe, with the respective opening located inside the respective hollow sphere. This type of protective covering shields the intake and exhaust openings against precipitation, even if falling at an angle, and also water splashing up from the ground. In addition to the vents, a fan may also be provided in the energy room to increase the volume of exchanged air.

If the body is made up of a plurality of body segments, then they need to be connected to each other. Turnbuckles are particularly suitable fasteners for connecting adjacent body segments and cover segments. They are commercially available components that have been tried and tested in practice and are able to take high loads. Using a suitable number of turnbuckles ensures that the segments of the body are held together reliably and securely in a watertight and explosion-proof manner.

It may be desirable that the body of the energy room be a water-tight structure, to protect the interior of the energy room against the ingress of groundwater and surface water and to provide good corrosion protection for the technical components that are installed in the energy center. The body and cover may be made of a concrete material that is impermeable to water and water-tight seals may be provided between abutting wall segments and cover segments. The two pass-throughs in the body, through which service lines pass into and out of the energy room, may be sealed by means that are known per se. For example, waterproof wall ducts are known in the building industry and may be used in the pass-through openings. It is also desirable to keep the number of openings through the shell of the body as low as possible and this is achieved by using multi-branch lines, so that in the best case only one multi-branch line extends through the body to the building and only one multi-branch line extends from the body to public utilities or a sewage system.

As mentioned above, the body and the cover may be produced in segments, end segments and extension segments for the body, and cover segments for the cover. The various segments are then transported to the installation site and assembled on site. The technical devices and equipment may be pre-assembled in the respective body segments before the segments are transported to the site and lowered into place in the pit. With this type of pre-assembly, once the body segments are fastened, the various supply and disposal lines just need to be connected to the building on the one side and to the public utilities on the other side, and the energy center is ready for operation.

Alternatively, the various technical devices may be pre-assembled in frame or rack and connections made between devices as needed. The pre-assembled frame is then installed in the body at the construction site before the cover is put in place. Mounting the technical devices and equipment in a frame eliminates the need for a large number of fastening points in the walls of the body for securing the components. Instead, the frame is attachable at a few securing points to the walls, so as to prevent it from tipping over. The frame itself may contain a large number of fastening points, provided, for example, in a grid layout, to provide sufficient fastening points for the individual devices in the frame.

Pre-assembling the technical installations—whether in the body or in the aforementioned frame—considerably simplifies and accelerates the assembly of the energy center. Pre-assembly, as the term is used herein, does not refer to the production of the individual devices themselves, but rather to assembling them into a practically ready-to-connect system that contains the technical devices required for the building, with any necessary inter-device connections also pre-assembled. This pre-assembly is particularly advantageous because it significantly reduces the time required to get the energy center ready for operation and if the energy center is to be set up beneath a fire lane, a private road, or the like, the amount of time that access to the fire lane or road is blocked is kept to a minimum. The pre-assembly is also important, because the time that the installation technicians, HVAC technicians, electricians, and heating engineers, and tradespeople need to set up an energy center with pre-assembled and ready-to-connect devices is much shorter than if they had to set up and make the connections for all the devices individually. In view of the currently prevailing shortage of skilled workers and the need to technologically convert as many buildings as possible in the shortest possible time as part of a transition to forms of energy that have low-carbon or zero-carbon emissions, this aspect is of great importance. There is an additional advantage to pre-assembling the devices and equipment for energy centers, namely, it is more economical in terms of logistics and also environmentally, if the technical devices and equipment, which come from different manufacturers, can be shipped in larger numbers to central locations where large number of such energy centers are pre-assembled, rather than shipping individual orders for each energy center. It takes much less time to assemble the various components, either in the body or body segments, or in the frame that was mentioned above, when done under industrial conditions, in a facility set up for such work and in conditions protected from the elements of the weather, than it does to assemble the same devices on site.

Regardless of how complex a planned energy center is or how many different technical devices it contains, the time to get an energy center that is pre-assembled as described above in condition for operation is just a day or two. Complex energy centers that contain many different technical devices would otherwise require a construction time of several weeks if the various technical devices had to be delivered to the installation site and installed there individually.

A crane and lifting gear attached to the crane are used to lift and lower the various components of the energy room. Ideally, the body, be it a single component or made up of two or more segments, is lowered into the pit, without the cover. The interior of the energy room is then readily accessible for technicians to set up the equipment for the energy center and/or to make the necessary connections. The cover is placed over the body after installation work within the energy room has been completed. Because the entire body or a body segment is not lifted at the cover, the fasteners that attach the cover to the body do not have to bear the weight of the body or body segment. Threaded sleeves may be provided on the body and perhaps also on the cover for receiving threaded fasteners that are attached to the ends of the crane lifting gear. Ideally, the threaded sleeves are placed horizontally within the upper region of the walls, with the threaded opening accessible either from the outside or the inside, depending on what is most suitable for the particular installation. The threaded sleeves may protrude slightly beyond the upright surfaces, but preferably, they end flush with the wall surface or even slightly inside the surface in question, to avoid being damaged.

Threaded connectors, such as eye bolts, hooks or the like, are attached to the ends of the lifting gear, for example, chains or belt, and are screwed into the threaded sleeves. The component is then lifted by the crane and lowered onto a transport vehicle or into a prepared pit, whereby the component may be the entire body with or without the cover, a complete cover, or an end segment, an extension segment, or a cover segment. The horizontal alignment of the threaded sleeves means that the lifting load is transverse to the central axis of their thread, so that they can withstand high loading. Ideally, the lifting gear has one or more crossbeams so that the flexible chains, ropes, or belts of the lifting gear extend as straight as possible from the traverse to the lifting gear connectors in the threaded sleeves, and do not come into direct contact with the component being lifted/lowered. This prevents oblique forces from impermissibly loading the component, and also prevents abrasion or kinking of chains, ropes or belts, If access to the threaded sleeves is on the outside of the component to be lifted, the lifting traverses must be longer than the dimension that they span, so that the lifting gear connectors can be threaded into the sleeves. Providing access to the threaded sleeves on the outside of the walls has the advantage that the inside walls are uninterrupted. The pit that is dug to receive the energy room has sloping sides that provide sufficient space for the connectors to be threaded into the sleeves without difficulty when the body is in the pit. Alternatively, it may be desirable to provide access to the threaded sleeves on an interior surface. This has the advantage that the sleeves are readily accessible at a later date. For example, it is possible that the energy room has been in the ground and surrounded by soil for years, but for some reason needs to be removed or replaced. Providing access to the sleeves on the interior also has the advantage that they may serve to secure equipment that is installed in the energy center.

Depending on the particular location where the energy room is to be installed, the body may be anchored in the ground, to prevent it from floating up in the case of a rise in water level, e.g. due to heavy rain or flooding. Reinforcement material that is provided in the lower region of the wall or in the floor of the body and that protrudes laterally from the walls or floor may serve as the ground anchors. When transporting the body or a body segment, the ground anchors may be folded upwards so that they extend close to the wall. The ground anchors are then folded out to a horizontal orientation once the body has been placed in the pit and/or the segments have been fastened together to form the body. Soil is then filled over the ground anchors, or the anchors are embedded in concrete that is poured at the site, to anchor the body of the energy center securely in place.

The energy room may be constructed to withstand the weight of vehicles, such as automobiles and trucks, including emergency vehicles, such as fire trucks. In this case, the cover of the energy room must have the necessary rigidity and compressive strength. A 25 or 30 cm thick concrete slab provides the necessary compressive strength and also the desired weight that is needed to absorb explosive pressures and prevent components and equipment from the energy center being blown uncontrollably out of the energy center in the event of an explosion.

The fact that vehicles will be traveling across the energy room means that shear forces will be exerted on the cover in the horizontal direction, for example, when the brakes are applied, and that these forces will be transmitted to the walls. Thus, the walls, too, need to be able to absorb the loads and transmit them downwards into the ground. The threaded fasteners that are used to attach the cover to the walls permit the transfer of these shear forces. It is also possible to provide a form-fit construction between the cover and the walls. One such suitable construction is a tongue and groove fit between cover and walls. Protrusions or extending surfaces on the underside of the cover that extend downward and make contact with the inside surface of the walls is another suitable form-fit construction that prevents the cover from shifting. Alternatively, the cover may be constructed as a hood that fits neatly over the walls, which also prevents the cover from shifting.

Constructing the energy room to withstand the loading when emergency vehicles drive across it significantly expands the choice of suitable locations for a proposed installation of the energy room. In urban areas, available open spaces are often very few, thus, it is an advantage when the energy room can be installed under roadways, and particularly, under private roads or fire lanes. Fire lanes are typically kept free of parked vehicles, so they offer the additional advantage that the energy room is readily accessible for inspection or maintenance work.

The energy center according to the invention is an energy room that contains various technical devices and equipment, for generating and/or for storing forms of energy that are then delivered to the building upon demand, i.e., at a time when the energy is needed. In this way, the energy center serves to increase the degree of energy self-sufficiency of the building. Some forms of energy may be generated at the building and then stored in the energy center. For example, a photovoltaic system mounted on the building may generate electrical energy that is then converted into thermal energy by heating water, which is then stored in a hot-water tank that is installed in the energy center. Or the electrical energy may be used to generate hydrogen gas, which is then stored in a hydrogen tank in the energy center and used as needed in a heating system, or possibly stored in the energy center and used later to generate electrical energy that is then supplied to the building.

The energy center may contain an electrical energy storage device that is a rechargeable battery, also called an accumulator, whereby the electrical energy is generated by a photovoltaic system that is mounted on the building. Energy markets are often very volatile, and sometimes the cost for purchasing electrical energy is relatively low temporarily. Having the rechargeable storage battery also allows electrical energy to be acquired during low-cost times and stored for later use.

The energy center may contain a gas storage tank for storing hydrogen that has been generated by an electrolyser, which in turn may be powered by electrical energy from the photovoltaic system mounted on the building and/or by the electric energy storage device in the energy center. Other technical devices may also be installed in the energy center, e.g. a compressor for compressing the hydrogen gas to a liquid. The hydrogen may be used as fuel for a heating system or a BTTP unit. The electrolyser or fuel cell may also be installed in the energy center and used to convert hydrogen to energy, thereby using hydrogen technology as an alternative or in addition to storing electrical energy in a battery or accumulator.

The energy room according to the invention is typically set up on location when a new building is under construction. One of the main advantages of the energy room and energy center according to the invention is that they allow the installation and hook-up of the service lines and the technical devices and equipment to be completely de-coupled from the construction of the building. This de-coupling allows the body of the energy room to be placed in the ground and the various technical equipment and storage devices installed therein, before the cover is placed across the top of the body. In other words, the energy center can be assembled and technicians can install the technical equipment inside the energy center, independent of the stage of construction of the building, so that the energy center is ready for operation as soon as the connections are hooked up to the building. At that point, the supply and disposal lines are then connected to the public utilities service lines on the public utilities connector site and to the building services connector site that leads to the building.

Typically, when a residential or commercial building is constructed, the public utilities are connected to the building at different times and by different companies. One of the advantages of the energy center is that a company that installs and maintains technical systems for buildings can install all the technical systems for the building at the same time. The fact that one company installs the various technical systems increases the reliable interaction of the systems. Also, the equipment is installed before the cover is lowered onto the body of the energy center, which provides easy access to the interior of the energy center. The cover is then placed across the body only after all the necessary equipment has been installed in the energy center.

The concept of providing the body and the cover in segments has the advantage that the body and cover segments for a relatively large energy center are transportable over public roadways without requiring special permits. The various segments are then assembled on site, and because the weight of the individual components is much less than that of a complete body, the load capacity of the crane and lifting gear required to lift and place the segments into position at the site is lower, which also results in lower rental costs for the equipment.

Once the energy center has been completely installed and the cover put in place, it may be desirable to provide some aesthetic features. A frame or low fence-like structure may be provided along the circumferential edge of the cover, to provide a separate area for holding plants, e.g. low-growth bushes or other types of decorative plants.

BRIEF DESCRIPTION OF THE DRAWINGS

The present invention is described with reference to the accompanying drawings. In the drawings, like reference numbers indicate identical or functionally similar elements. The drawings are not drawn to scale.

DETAILED DESCRIPTION OF THE INVENTION

The present invention will now be described more fully in detail with reference to the accompanying drawings, in which the preferred embodiments of the invention are shown. This invention should not, however, be construed as limited to the embodiments set forth herein; rather, they are provided so that this disclosure will be complete and will fully convey the scope of the invention to those skilled in the art.

Figure 1:
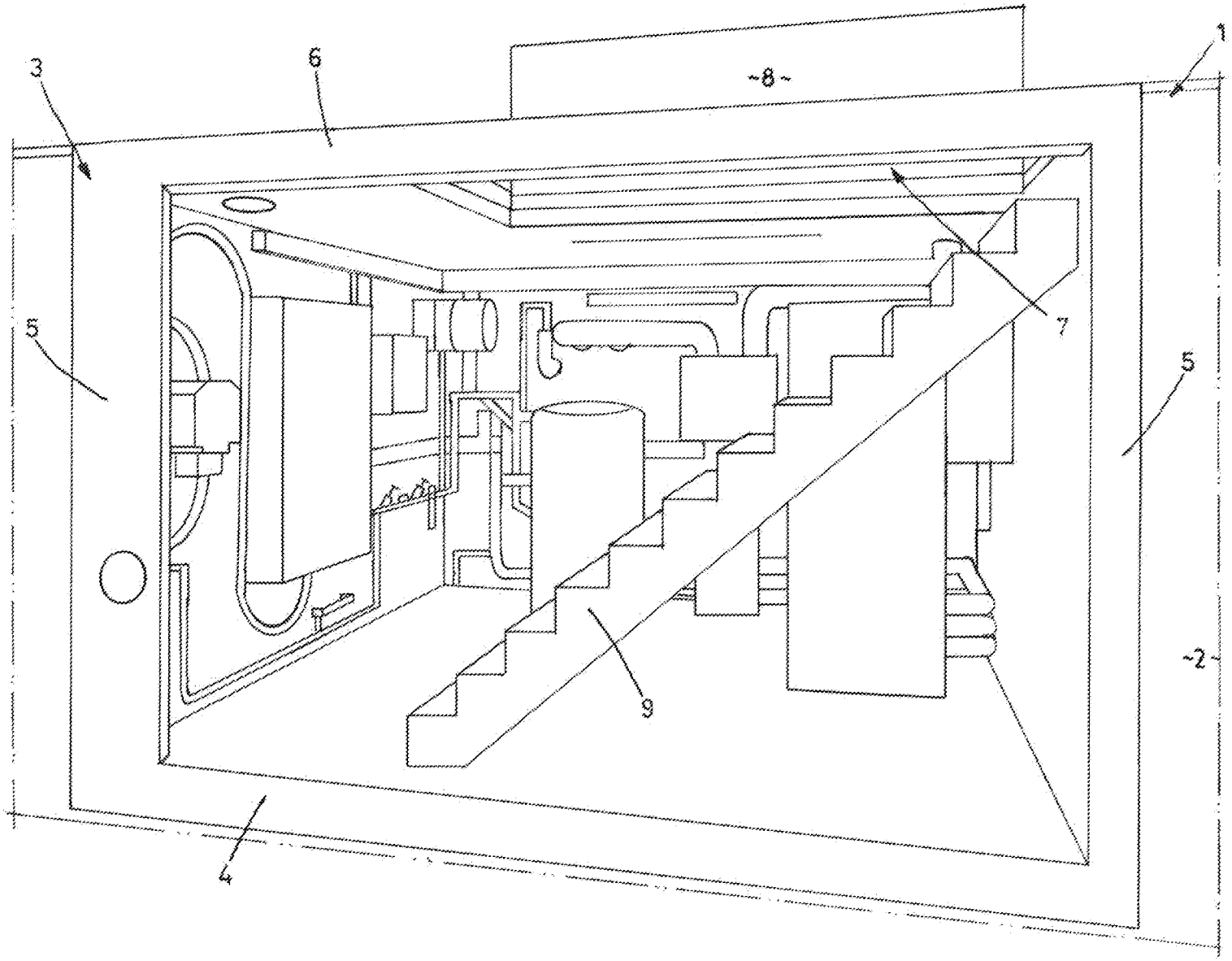
FIG. 1 is a perspective view through a vertical cross-section into a first embodiment of an energy room according to the invention, showing a stairway, various technical devices, installations, and conduits.

FIG. 1 shows an energy room 1 according to the invention that is installed in the ground 2. The energy room 1 is an enclosed space formed by a body 3 that has a floor 4 and walls 5, and a cover 8. An access opening 7 having a hinged hatch or access door 6 is provided in the cover 8. The access door 6 is dimensioned sufficiently large to allow a person and equipment to pass through the access opening 7 and is secured in place by means of a lock device (not shown) which prevents unauthorized persons from accessing the interior of the body 3, but which is mechanically weak enough, that in the event of an explosion occurring inside the body 3, the pressure build-up will force the access door 6 open. In this way, the access door 6 also serves as an overpressure relief valve. A stairway 9 is installed within the body 3. The stairway 9 also has a handrail 15, which is not shown in this illustration for reasons of clarity.

Figure 3:
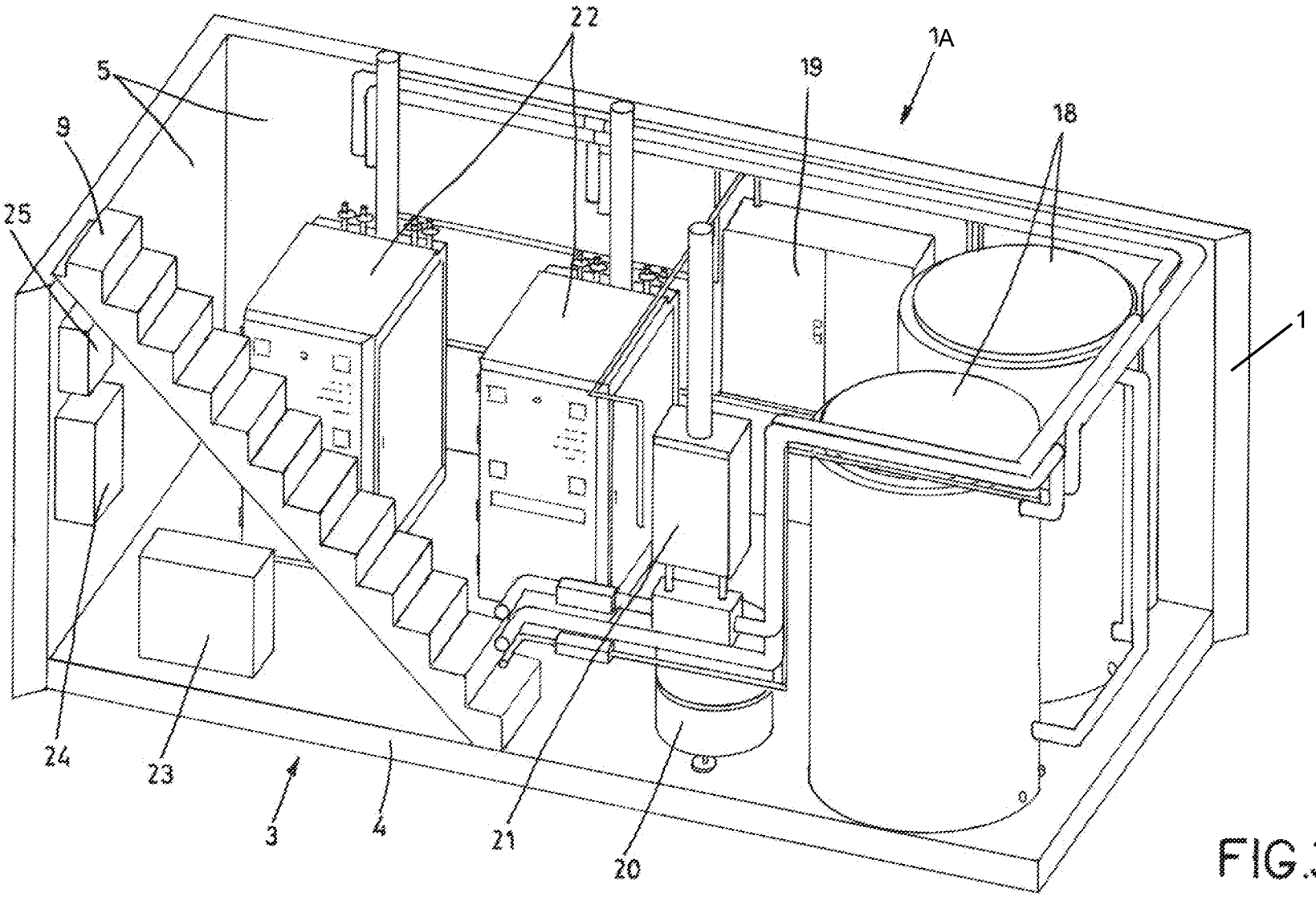
FIG. 3 is a perspective view obliquely from above of an energy center according to the invention, with two walls and the cover removed, illustrating various devices and equipment installed within the energy center.

FIG. 1 illustrates various kinds of technical equipment that may be installed within the energy room 1, which, when such equipment is installed is then referred to as an energy center 1A, an embodiment of which is shown in FIG. 3. The kinds of equipment typically installed in the energy center include conduits, shut-off valves, meters, an electronic controller, and energy storage devices, for example, a large rechargeable battery for storing electrical energy, and storage tanks, for example, a tank for storing hydrogen gas and a hot water tank for storing heat.

Figure 2:
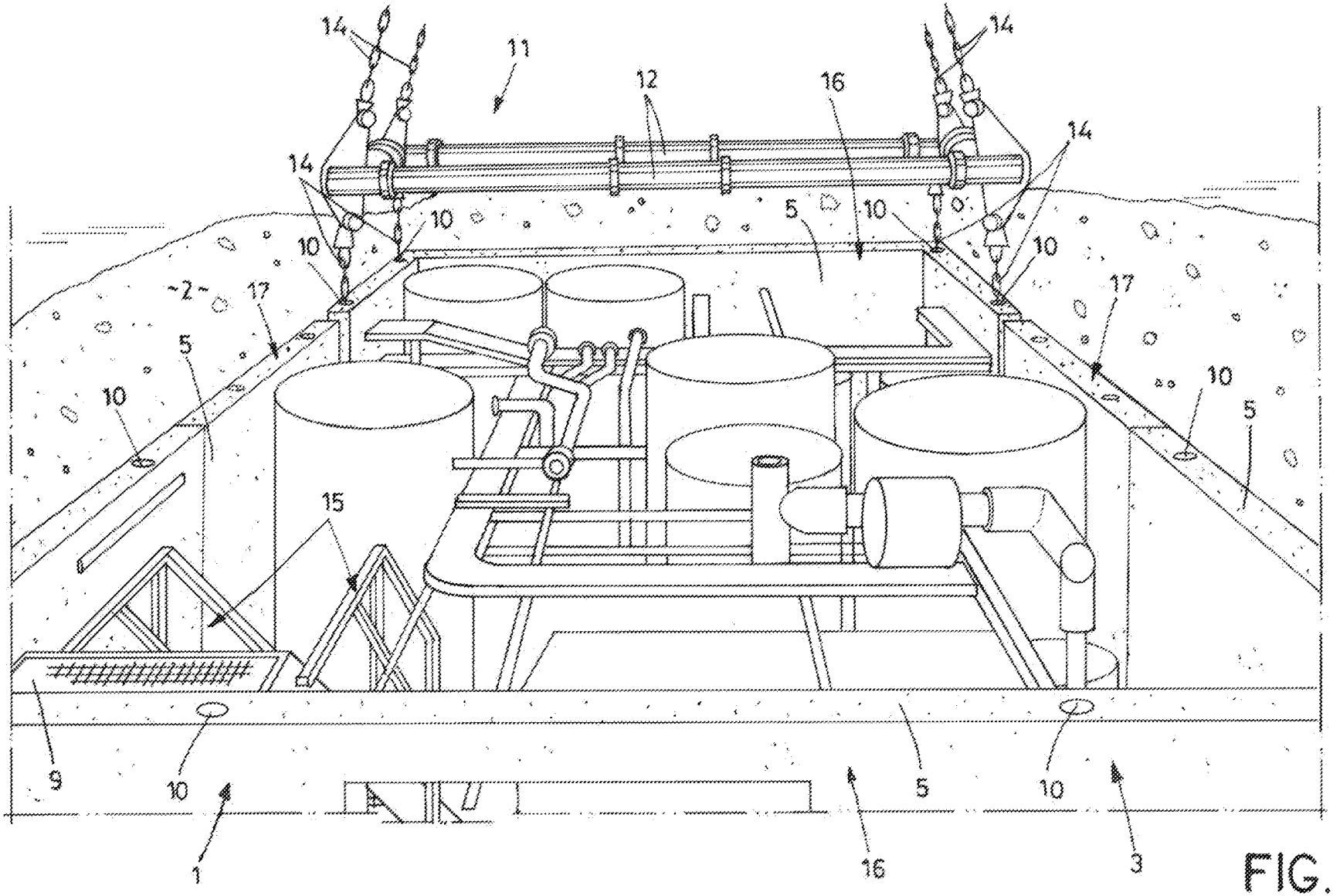
FIG. 2 is a perspective top view of the body of a second embodiment of an energy room according to the invention that is in the process of being installed at a construction site, showing pre-assembled storage devices and conduits.

FIG. 2 illustrates a second embodiment of the energy room 1 in which the body 3 is made up of three separate body segments, two end segments 16, and an extension segment 17 that is placed between the end segments 16. FIG. 2 also shows the rear end segment 16 still suspended from a lifting means 11, in the process of being lowered into its final position. A plane view from above onto either one of the end segments 16 would show a structure having three walls 5 that form a U-shape. In fact, none of the segments 16 and 17 has four walls. Each end segment 16 and extension segment 17 also includes the floor 4, which is not visible in this illustration.

This segmented construction of the body 3 allows the size of the energy room 1 to be easily adapted to accommodate the particular needs of each individual energy center. The appropriate number of extension segments 17 are placed between two end segments 16 to obtain the desired dimensions of the body 3. The cover 8 may also be manufactured in segments so that each end segment 16 and each extension segment 17 has its own cover 8.

The end segments 16 and extension segments 17 preferably have the same footprint or surface area, i.e., the same width and length, because then one size of the cover 8 will fit over each type of body segment 16 and 17. This also means that only three components, the end segment 16, the extension segment 17, and the cover 8 need be provided in order to construct the body 3 of the energy room 1 that is adapted to the required size.

The body 3 of the energy room 1 illustrated in FIG. 2 shows that the technical devices and equipment that are to be housed within the energy center 1A, i.e., storage tanks, electrical devices, conduits, etc., have been pre-assembled in two respective end segments 16 and an extension segment 17. This pre-assembly is done in an industrial setting, prior to bringing the segments 16 and 17 to the construction site. The pre-assembled segments 16 and 17 are then transported to the construction site and lowered by a crane into the ground 2. The end segments 16 are then fastened to the extension segment 17 in a manner that creates a water-tight connection between the segments. The technical devices and equipment installed within the body 3 are then hooked up to the corresponding electrical lines, conduits, and, as required, to other devices within the body. Also shown in FIG. 2 is the stairway 9, with handrails 15 mounted on each side.

Alternatively to the pre-assembled segments shown in FIG. 2, the technical devices and equipment that are to be assembled in the energy room 1 may be pre-assembled on a frame or rack. In this case, the frame or rack is either set up as a free-standing installation in the body 3 or is secured at several points to the walls 5, to prevent tipping.

Still referring to FIG. 2, one can see that the lifting means 11 includes lifting traverses 12 and chains 14 that are attached to connecting elements 10 that are provided in the upper face of the walls 5. A crane (not shown) is used in a manner known per se to lift the body 3 or, should the body include several separate segments, each respective end segment 16 and extension segment 17.

FIG. 3 is a perspective view from above of an embodiment of the energy center 1A according to the invention. To better illustrate the interior of the energy center 1A, two walls and the cover have been eliminated in this illustration. Two buffer storage tanks 18 for a heating system stand on the floor 4 at one end of the body 3. A cabinet for an electrical sub-distribution panel 19 is mounted on the rear wall. A pressure compensation tank 20 for the heating system is set up on the floor 4, and above it is a peak load boiler 21 for the heating system, which is mounted on what would be the front wall of the body 3, but which is not shown in this view. Two hydrogen combination units 22 are set up on the floor 4, each of these combination units 22 containing an electrolyser for electrically generating hydrogen, a hydrogen storage tank for the generated hydrogen gas, and a fuel cell to generate on demand electrical energy or heat from the stored hydrogen.

An energy storage device 23 is set up beneath the stairs 9. This energy storage device 23 serves as intermediate storage for electrical energy that is generated, for example, by a photovoltaic system that is located on the roof of a building that is associated with this energy center 1A. A system control panel 24 is mounted on the wall 5 beneath the stairs 9. This system control panel 24 controls the functional interaction of the devices within the energy center 1A and the interaction of these devices with other technical devices that are connected to them, for example, the photovoltaic system on the building. A meter panel 25 is also mounted on the wall 5 beneath the stairs 9, at eye level. A controller that regulates the energy that is fed to individual residential units may also be included in the meter panel 25, but such a controller may also be mounted in the cabinet for the system controller 24.

It is understood that the embodiments described herein are merely illustrative of the present invention. Variations in the construction of the energy room and the energy center may be contemplated by one skilled in the art without limiting the intended scope of the invention herein disclosed and as defined by the following claims.

The invention claimed is:

1. An energy room for providing energy to a building that is physically separate from the energy room, the energy room comprising:

a body having walls and a floor;

a cover that is placed across an upper face of the body;

an access opening provided in the cover that allows a person access to an interior of the body;

an access door that opens and closes the access opening;

at least one public utilities pass-through and at least one building services pass-through in the body for supply lines that lead into and out of the energy room;

and at least one storage device for storing energy that is supplied to the building upon demand;

wherein the cover is attached to the body by means of releasable fasteners that are fire and explosion-proof; and wherein the access door in the access opening serves as an overpressure relief valve that opens automatically when an overpressure builds up inside the body beyond a specified limit value.

2. The energy room of claim 1, wherein the releasable fasteners that attach the cover to the body are turnbuckles.

3. The energy room of claim 1, wherein a water-tight seal is provided between the walls and the cover.

4. The energy room of claim 1, wherein the body has connection means for receiving lifting gear connectors.

5. The energy room of claim 4, wherein the connection means for lifting gear connectors includes a plurality of threaded sleeves that are horizontally oriented and open into vertical surfaces of the body, for releasably receiving the lifting gear connectors.

6. The energy room of claim 1, wherein the cover has connection means for receiving lifting gear connectors.

7. The energy room of claim 1, further comprising:

a stairway with a handrail that is accessible from outside the body via the access opening.

8. The energy room of claim 1, wherein the body is made up of at least two end segments, each end segment having three walls and a floor.

9. The energy room of claim 8, wherein the body includes one or more extension segments, each extension segment having two opposing walls and a floor, and wherein the one or more extension segments are placed between the at least two end segments, so as to achieve a desired length of the body.

10. The energy room of claim 9, wherein the cover over the body includes a plurality of cover segments;

wherein the at least two end segments and the one or more extension segments have the same basal area;

wherein one of the cover segments from the plurality of cover segments fits across the at least two end segments or the one of more extension segments; and wherein the number of cover segments in the plurality of cover segments are at least equal in number to the total number of the at least two end segments and the one or more extension segments.

11. The energy room of claim 1, wherein at least a portion of the walls and/or the floor are made of self-compacting concrete.

12. The energy room of claim 1, wherein the cover is made of self-compacting concrete.

* * * * *